US008154363B2

(12) United States Patent
Kaegebein

(10) Patent No.: US 8,154,363 B2
(45) Date of Patent: Apr. 10, 2012

(54) BAND PASS FILTER WITH TUNABLE PHASE CANCELLATION CIRCUIT

(75) Inventor: Daniel P. Kaegebein, Depew, NY (US)

(73) Assignee: Comprod Communications Corporation, Boucherville, Quebec (CA)

( * ) Notice: Subject to any disclaimer, the term of this patent is extended or adjusted under 35 U.S.C. 154(b) by 699 days.

(21) Appl. No.: 12/291,854

(22) Filed: Nov. 14, 2008

(65) Prior Publication Data

US 2009/0121937 A1 May 14, 2009

Related U.S. Application Data

(60) Provisional application No. 61/003,024, filed on Nov. 14, 2007.

(51) Int. Cl.
*H01P 1/205* (2006.01)

(52) U.S. Cl. ..... 333/207; 333/223; 333/230

(58) Field of Classification Search ..... 333/208, 333/209, 219, 227, 230–232, 235, 156, 160, 333/206, 207, 223
See application file for complete search history.

(56) References Cited

U.S. PATENT DOCUMENTS 5,831,490 A * 11/1998 Sarkka et al. ..... 333/126

OTHER PUBLICATIONS

Thomas, "Cross-Coupling in Coaxial Cavity Filters—A Tutorial Overview", 2003, IEEE, vol. 51, pp. 1368-1376.*
Kubo et al, English Translation of "TM Multiplex Mode Dielectric Filter",Feb. 2, 1996, publication No. JP 08-032305.*

* cited by examiner

*Primary Examiner* — Benny Lee
*Assistant Examiner* — Gerald Stevens
(74) *Attorney, Agent, or Firm* — Simpson & Simpson, PLLC

(57) ABSTRACT

A phase cancellation circuit for a cavity filter including a sampler loop assembly arranged to receive an input signal, a variable loop assembly connected to the sampler loop assembly by a cable, wherein the variable loop assembly is arranged to transmit an output signal from cavity filter, wherein the sampler loop assembly samples a cancellation signal at an isolation frequency from the input signal and transmits the cancellation signal to the variable loop assembly via the cable, and, wherein the cable has a length equal to a multiple of a half-wavelength at the desired isolation frequency, wherein the cancellation signal undergoes a 180° phase shift by traveling through the cable, wherein the variable loop assembly combines the cancellation signal with the input signal to cancel the input signal at the isolation frequency due to the 180° phase shift for creating the output signal with a notch at the isolation frequency.

8 Claims, 6 Drawing Sheets

BAND PASS FILTER WITH TUNABLE PHASE CANCELLATION CIRCUIT

CROSS REFERENCE TO RELATED APPLICATIONS

This patent application claims the benefit under 35 U.S.C. §119(e) of U.S. Provisional Application No. 61/003,024, filed Nov. 14, 2007, which application is incorporated herein by reference.

FIELD OF THE INVENTION

This invention relates to filters used in the field of RF communication, more specifically to cavity filters, and even more specifically to phase cancellation circuits for bandpass cavity filters.

BACKGROUND OF THE INVENTION

A band pass cavity filter preferably passes one narrow band of frequencies and attenuates all others with increasing attenuation above and below the pass frequency. Band pass filters are ideal when the interfering frequencies are not known to any degree of accuracy or when very broadband filtering is needed. Collectively, the frequencies that are allowed to pass are called the pass band.

Bandpass filters are well known in the art. An example of a bandpass cavity filter is shown in FIG. 1. Cavity filter 2 includes a hollow cylindrical body 3 which has a coarse tuning rod 4 and a fine tuning rod 5. Apertures 6 are arranged with screws 7 for securing loop assemblies 8 to the cavity filter. When properly installed, the loops of loop assemblies 8 are contained in the cavity filter, while connectors, jacks, or receptacles 9 protrude out from the cavity filter. Connectors 9 are generally bi-directional, and connect to coaxial cables for either receiving or transmitting signals to or from the filter.

However, communications equipment, receivers particularly, may require additional isolation at specific frequencies. One solution to solve this problem is to connect separate notch filters to the bandpass filter to provide isolation at each of the desired frequencies. However, this is not always ideal as it requires multiple filters to be used, which can be costly, and requires a substantial amount of additional space to install extra cavity filters.

Thus, what is needed is a device to be used with a bandpass cavity filter to provide isolation at desired frequencies without the need for multiple cavity filters. What is also needed is such a device that is tunable.

BRIEF SUMMARY OF THE INVENTION

The present invention broadly comprises a phase cancellation circuit for a cavity filter including a sampler loop assembly arranged to receive an input signal, a variable signal insertion loop assembly connected to the sampler loop assembly by a cable, wherein the variable signal insertion loop assembly is arranged to transmit an output signal from cavity filter, wherein the sampler loop assembly samples a cancellation signal at an isolation frequency from the input signal and transmits the cancellation signal to the variable signal insertion loop assembly via the cable, and, wherein the cable has a length equal to a multiple of a half-wavelength at the desired isolation frequency, wherein the cancellation signal undergoes a 180° phase shift by traveling through the cable, wherein the variable signal insertion loop assembly combines the cancellation signal with the input signal to cancel the input signal at the isolation frequency due to the 180° phase shift for creating the output signal with a notch at the isolation frequency.

In one embodiment, the cavity filter is a bandpass cavity filter. In another embodiment, the sampler loop assembly comprises a bulkhead connector for receiving the input signal, a connector block secured to the bulkhead connector, wherein the connector block is hollow and includes an aperture for enabling insertion of the cable into the connector block, a loop ring secured to the connector block opposite from the bulkhead connector, and a loop extending out of the connector block, wherein a first end of the loop is affixed to a center pin of the bulkhead connector and a second end of the loop is grounded to the loop ring. In a further embodiment, a first end of the cable is stripped to a center conductor wire of the cable, and the center conductor wire is affixed to the center pin of the bulkhead connector and to the loop. In yet a further embodiment, a rigid sleeve is affixed to the cable proximate to the first end of the cable, and wherein the rigid sleeve is positioned in the aperture and clamped to the connector block by a set screw.

In one embodiment, the variable signal insertion loop assembly comprises a bulkhead connector for transmitting an output signal, a connector block secured to the bulkhead connector, wherein the connector block is hollow and includes an aperture for enabling insertion of the cable into the connector block, a loop ring secured to the connector block opposite from the bulkhead connector, a coupling tube housed within the connector block, wherein the coupling tube includes a hole for partial insertion of a central pin of the bulkhead connector into the coupling tube, wherein the couple tube rests on a non-conductive spacer that separates the bulkhead connector from contacting the coupling tube, a dielectric ring concentrically arranged within the coupling tube, and a loop extending out of the connector block, wherein a first end of the loop is affixed to a the coupling tube and a second end of the loop is grounded to the loop ring.

In a further embodiment a second end of the cable is stripped down to a center conductor wire of the cable, wherein the center conductor wire is fitted with a voltage probe, and wherein the voltage probe is inserted through the aperture in the block connector and concentrically positioned within the dielectric tube for creating a field coupling between the coupling tube and the voltage probe. In yet a further embodiment a rigid sleeve is affixed to the cable proximate to the second end of the cable, and wherein the rigid sleeve is positioned in the aperture and clamped in place by a shaft lock arranged about the aperture.

The current invention also broadly comprises a method of creating a notch in a signal at a desired isolation frequency transmitted through a cavity filter including the steps of (a) receiving an input signal with a cavity filter, (b) sampling a cancellation signal from the input signal at the desired isolation frequency, (c) shifting the cancellation signal 180° by transmitting the cancellation signal through a cable having a length equal to a multiple of a half-wavelength at the desired isolation frequency, (d) combining the cancellation signal with the input signal for cancelling the input signal at the desired isolation frequency, thereby creating an output signal that substantially resembles the input signal, but with a notch at the desired isolation frequency, and (e) transmitting the output signal from the cavity filter.

In a further embodiment a sampler loop assembly of the cavity filter receives the signal in step (a), and the sampler loop assembly samples the cancellation signal in step (b), a variable signal insertion loop assembly combines the cancellation signal with the signal in step (d), and the sampler loop assembly, the variable signal insertion loop assembly and the cable comprise a phase cancellation circuit. In another embodiment the method further includes the step of: (f) tuning the phase cancellation circuit by altering a position of a voltage probe with respect to a coupling tube housed within a connector block of the variable signal insertion loop assembly, wherein the voltage probe is affixed to one end of the cable. In one embodiment step (f) occurs before step (a).

The current invention also broadly comprises a cavity filter including a phase cancellation circuit for a cavity filter comprising a sampler loop assembly operatively arranged to receive an input signal to the cavity filter, a variable signal insertion loop assembly connected to the sampler loop assembly by a cable, wherein the variable signal insertion loop assembly is operatively arranged to transmit an output signal from cavity filter, wherein the sampler loop assembly samples a cancellation signal at a desired isolation frequency from the input signal and transmits the cancellation signal to the variable signal insertion loop assembly via the cable, and wherein the cable has a length, and the length is equal to a multiple of a half-wavelength at the desired isolation frequency, wherein the cancellation signal undergoes a 180° phase shift by traveling over the length of the cable, wherein the variable signal insertion loop assembly combines the cancellation signal with the input signal to cancel the input signal at the isolation frequency due to the 180° phase shift for creating the output signal, and wherein the output signal substantially resembles the input signal but with a notch at the desired isolation frequency. In one embodiment, the cavity filter is a bandpass filter.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects. Also, the adjectives, "top," "bottom," "right," "left," and their derivatives, in the description herebelow, refer to the perspective of one facing the invention as shown in the figure under discussion.

Furthermore, it should be understood that this invention is not limited to the particular methodology, materials and modifications described and as such may, of course, vary. It should also be understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
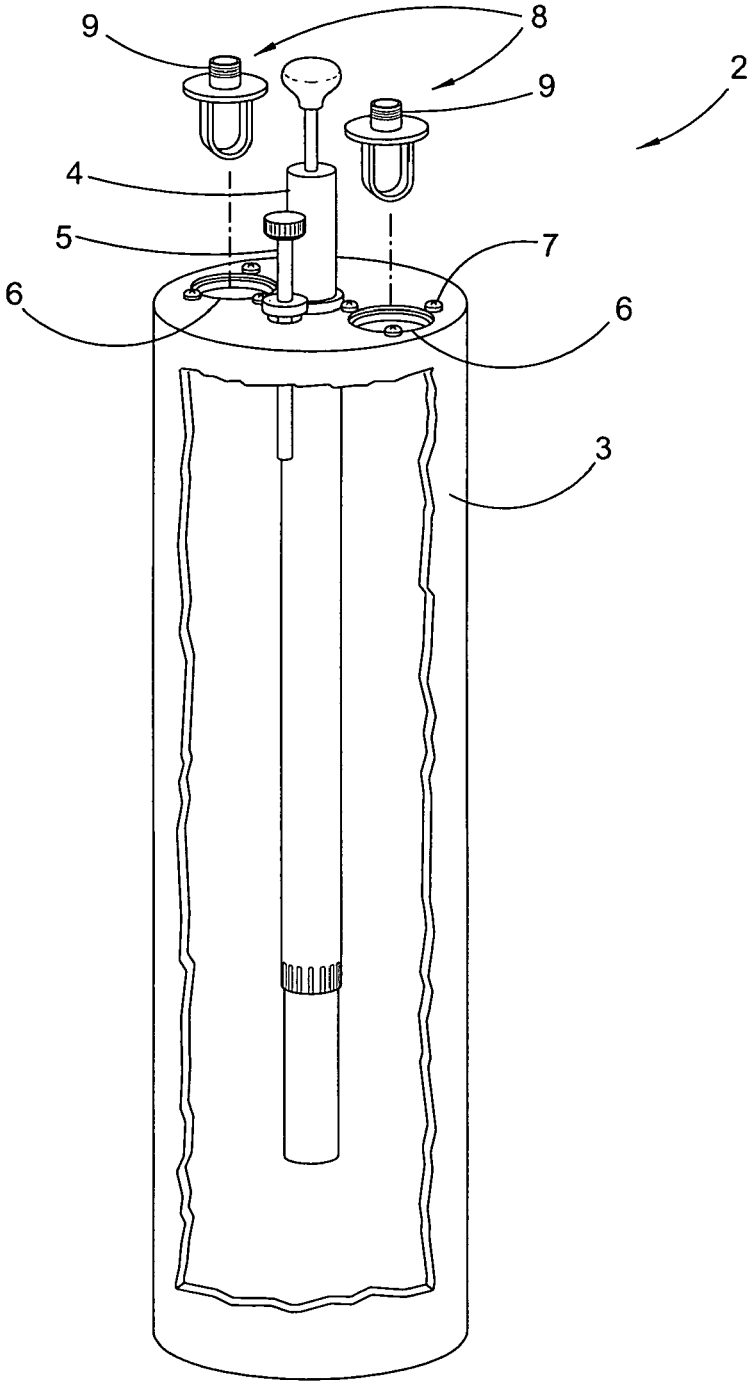
PRIOR ART Fig. 1
FIG. 1 is a perspective view of a typical bandpass filter.
Figure 2:
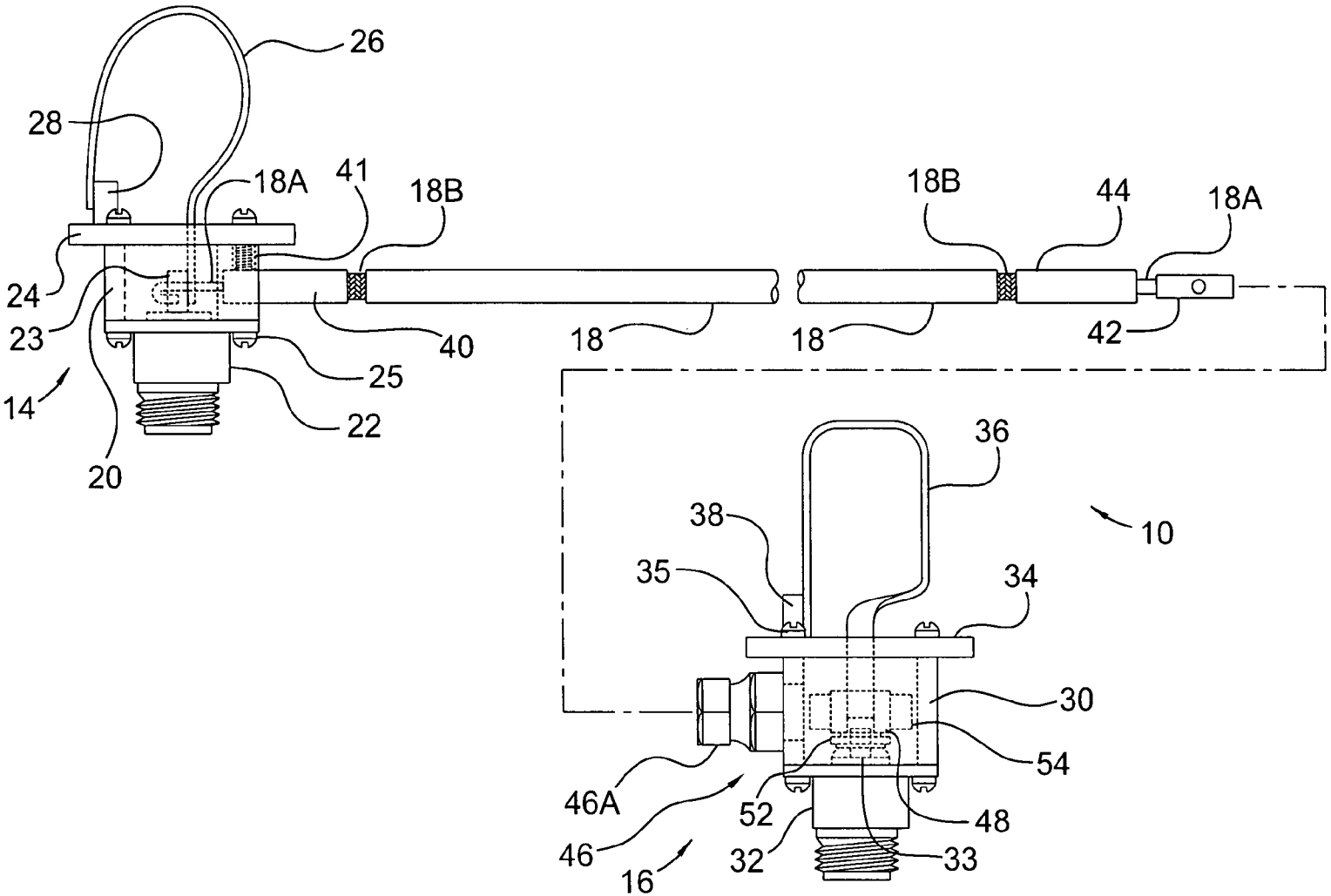
FIG. 2 is a side view of a phase cancellation circuit according to the current invention.
Figure 3:
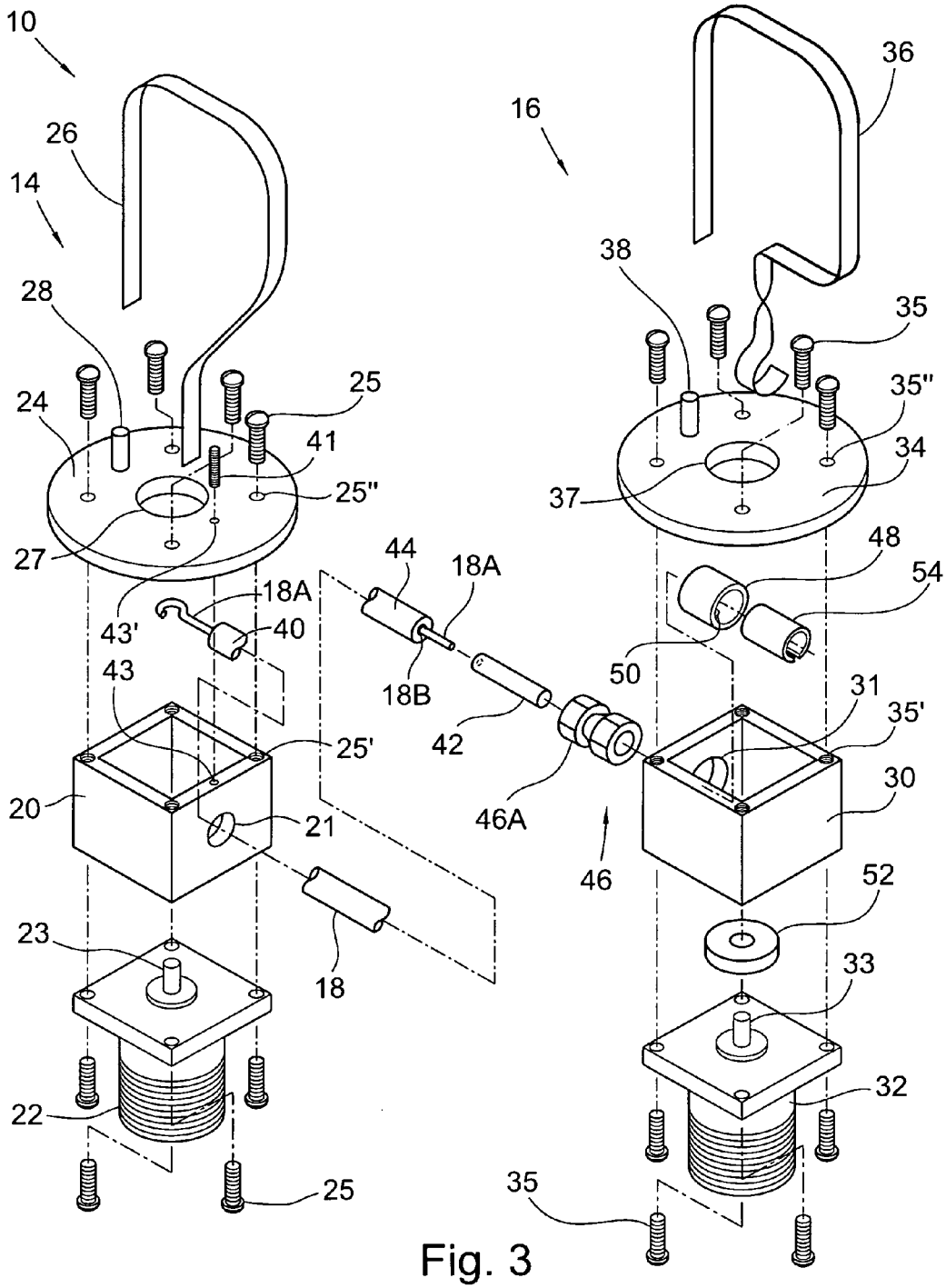
FIG. 3 is an exploded perspective view of the phase cancellation circuit shown in FIG. 2.

FIG. 2 shows a side view of phase cancellation circuit 10, while FIG. 3 shows an exploded perspective view of the phase cancellation circuit. The following description should be read in view of FIGS. 2 and 3. Phase cancellation circuit 10 is used in conjunction with a cavity filter, such as cavity filter 2 shown in FIG. 1. Phase cancellation circuit 10 includes sampler loop assembly 14 and variable signal injection loop assembly 16 connected by coaxial cable 18. As will be discussed in more detail infra, the length of cable 18 is equal to a half-wavelength of a signal at the frequency that isolation of the signal is desired. The loop assemblies in FIG. 2 are shown so that the inner components of the assemblies are illustrated in dashed or hidden lines.

In one embodiment, the cavity filter is cylindrical, such as cavity filter 2, but it should be understood that the cavity filter could be rectangular or any other configuration known in the art. Taking cavity filter 2 in FIG. 1, for example, phase cancellation circuit 10 would be installed by replacing loop assemblies 8 with one of each of loop assemblies 14 and 16. Alternatively stated, a cavity filter according to the current invention would almost exactly resemble cavity filter 2, with the exception of loop assembles 14 and 16 being installed in apertures 6 instead of loop assemblies 9. Loop assemblies 14 and 16 would be connected via cable 18.

In a preferred embodiment, cable 18 connects variable signal loop assembly 16 to sampler loop assembly 14. Cable 18 is preferably a 50-ohm coaxial cable, as is common in RF communication. In a preferred embodiment the cable is a readily purchasable, standard cable, made from a silver plated steel center conductor 18A surrounded respectively by a dielectric layer, double-braided shield layer 18B, and then jacketed in polytetrafluoroethylene. Cable 18 and its corresponding layers, particularly layers 18A and 18B, are illustrated in FIGS. 2 and 3. It should be apparent that other types of cables are known in the art, and this particular cable merely represents a preferred choice of cable.

In a preferred embodiment, connector block 20 is a hollow box. Aperture 21 enables cable 18 to access the interior of the connector block so the cable can be soldered to loop 26 and bulkhead connector 22. The connector block also has four thru-holes 25' on both the top and bottom of the block which are correspondingly threaded to receive screws 25.

Sampler loop assembly 14 includes connector block 20 which is connected to bulkhead connector 22 and loop ring 24. In a preferred embodiment the connector block is secured to each of bulkhead connector 22 and loop ring 24 by four screws 25. However, it should be appreciated that screws are not necessary, and that in an alternate embodiment, a different securing means known in the art, such as welding or soldering, could be substituted.

Loop 26 is shown extending out of hole 27 in loop ring 24 and affixed to grounding pin 28. In a preferred embodiment, grounding pin 28 is soldered to both loop ring 24 and loop 26. Loop ring 24 includes four apertures 25" for aligning with apertures 25' and engaging with screws 25 to secure the loop ring to the connector block. Loop ring 24 also includes hole 43' which is aligned with threaded bore 43 in connector block 20 for set screw 41. In a preferred embodiment loop ring 24 and grounding pin 28 are silver plated brass.

In a preferred embodiment, sleeve 40 is soldered to double braided shield 18B of cable 18 and secured to block 20 by set screw 41. In a preferred embodiment set screw 41 is a 4-40 set screw. It should be appreciated that other varieties of cabling which do not include a double braided shield layer could be substituted for cable 18, but that a double-braided cable is preferred. Furthermore, sleeve 40 could be secured to cable 18 by any other suitable method know in the art.

The end of loop 26 which extends inside of connector block 20 is soldered to connector pin 23 of bulkhead connector 22. In a preferred embodiment, loop 26 is secured by soldering. Also, cable 18 is partially stripped so that a portion of the center conductor 18A of cable 18 protrudes out of sleeve 40 into block connector 20. This portion of center conductor 18A of cable 18 is illustrated partially hooked around center pin 23. In a preferred embodiment, the center conductor 18A is soldered to loop 26 and connecting pin 23 of bulkhead connector 22.

Variable signal injection loop assembly 16 includes connector block 30 which is connected to bulkhead connector 32 and loop ring 34 by a total of eight screws 35. As discussed supra with respect to screws 25, an alternate embodiment may include a different means for securing the connector block to the loop ring and bulkhead connector. Loop 36 is shown extending out of hole 37 in loop ring 34 connecting to grounding pin 38. In a preferred embodiment, grounding pin 38 is soldered to loop ring 34 and loop 36. It should be appreciated that loop ring 34 and grounding pin 38 are substantially identical to loop ring 24 and grounding pin 28, with the exception of set screw hole 43 located in loop ring 24. Likewise, loop ring 34 includes four apertures 35" for aligning with apertures 35' and engaging screws 25 to secure the loop ring to the connector block.

In a preferred embodiment, connector block 30 is a hollow rectangular box similar to connector block 20. Aperture 31 is included to enable cable 18 and voltage probe 42 to access the interior of connector block 30 so the voltage probe can rest within dielectric tube 52 and create a field coupling with coupling tube 48. The connector block also has four thru-holes 35' on both the top and bottom of the block which are correspondingly threaded to receive screws 35.

In a preferred embodiment, loop 36 is a piece of copper strap which must be bent into the loop shape and twisted 90 degrees so that the loop can be affixed to coupling tube 48. In a preferred embodiment, loop 36 is soldered to the coupling tube, but it should be appreciated that other methods known in the art, such as bolting or screwing the loops to the coupling tube may also suffice. Coupling tube 48 has aperture 50 to provide access into the coupling tube from the central pin 33 on bulkhead connector 32. Coupling tube 48 rests on spacer 52. Spacer 52 is a non-conductive ring that surrounds central pin 33, and in a preferred embodiment is made of polytetrafluoroethylene. Dielectric tube 54 is also non-conductive and fits inside coupling ring 48. Voltage probe 42 is housed within dielectric tube 54 when voltage probe 42 is inserted into variable signal injection loop assembly 16 and held in place by sleeve 44 being clamped in shaft lock 46.

Voltage probe 42 includes a longitudinal bore which allows the probe to fit over and center conductor 18A of cable 18. In a preferred embodiment the voltage probe is a portion of brass rod with copper and silver plating. In a preferred embodiment, probe coupling tube 48 is a hollow brass tube. As discussed supra, dielectric tube 54 fits snugly inside probe coupling tube 48. The dielectric tube aids in the creation of a field coupling between the voltage probe and the coupling tube when a signal is passed through the filter.

One end of cable 18 is stripped of the jacketing material and double-braided shield 18B is soldered directly to sleeve 40. In a preferred embodiment sleeve 40 is partially inserted into aperture 21 in the side of block connector 20 and secured inside of connector block 20 with set screw 41. The opposite end of cable 18 terminates in voltage probe 42. Voltage probe 42 inserts inside of connector block 30. Similar to sleeve 40, sleeve 44 is soldered to the double-braided shield of cable 18. Sleeve 44 in combination with shaft lock 46 enables voltage probe 42 to be variably inserted into connector block 30, so that the voltage probe can create a field coupling with coupling tube 48 and dielectric tube 54. The sleeves are fabricated from a rigid material, such as a metal, and are included to enable the cable to be tightly clamped in place by set screw 41 and shaft lock 46.

Shaft lock 46 is operatively arranged so that it can selectively secure cable 18, and therefore voltage probe 42, in place. In a preferred embodiment, shaft lock 46 is operatively arranged to clamp down on sleeve 44 when a threaded hex nut 46A included on the shaft lock is tightened. The threaded hex nut can also be loosened to release sleeve 44. It should be appreciated that other methods of variably positioning the end of cable 18 connector block 30 could be used, and shaft lock 46 represents only a preferred means for selectively securing the voltage probe within block connector 30.

Bulkhead connectors 22 and 32 are bi-directional and can be used as inputs into the cavity filter, or outputs out of the cavity filter. In a preferred embodiment, the bulkhead connectors are standard electronic components which are readily purchasable and known in the art. In a preferred embodiment, connector 22 receives an input signal to the cavity filter while connector 32 transmits an output signal from the cavity filter. However, it should be appreciated that there are many styles of receptacles and connectors, and any other input or output connection means known in the art could be used.

In a preferred embodiment the loops are soldered to their respective grounding pins. However, it should be appreciated that some embodiments do not include grounding pins, but instead the loops are directly bolted or screwed to the loop rings, or use some other means known in the art to affix the loops to the loop rings for grounding purposes. It should be appreciated in a preferred embodiment, soldering is the method of affixing all electrical components in the phase cancellation circuit, but that this only represents a single preferred method.

As discussed supra, cable 18 is a standard cable known in the art, and has several components, including center conductor 18A, a dielectric layer, double braided shield 18B, and a jacketing. In a preferred embodiment, portions of the cable are stripped or exposed so the cable can be soldered to different components. For example, as discussed supra, the double braided shield is soldered to sleeves 40 and 44, and the center conductor is soldered to pin 23 of bulkhead connector 22.

The purpose of cable 18 is to transfer a sampled portion of the input signal at a desired isolation frequency to the output of the cavity filter 180 degrees out of phase. By desired isolation frequency we mean the frequency at which a user desires to position a notch, or achieve isolation. When combined with the input signal, the 180 degree phase shifted sample signal, or cancellation signal, cancels the input signal at the desired isolation frequency. Effectively, this results in a notch at the desired isolation frequency.

In order to achieve the 180 degree phase shift, the length of cable 18 is determined such that it is equal to a half-wavelength, or a multiple of the half-wave length of the desired isolation frequency. At low frequencies, the half wavelength is sufficiently long to enable the cable to connect the variable signal injection and sampler loop assemblies. At higher frequencies, however, the half-wave length shortens, and it becomes physically impossible to connect the sampler loop assembly to the variable signal injection loop assembly with a length of cable equal to only one half-wave length. Therefore, multiples of the half-wave must be used to provide the proper length of the cable.

Figure 4A:
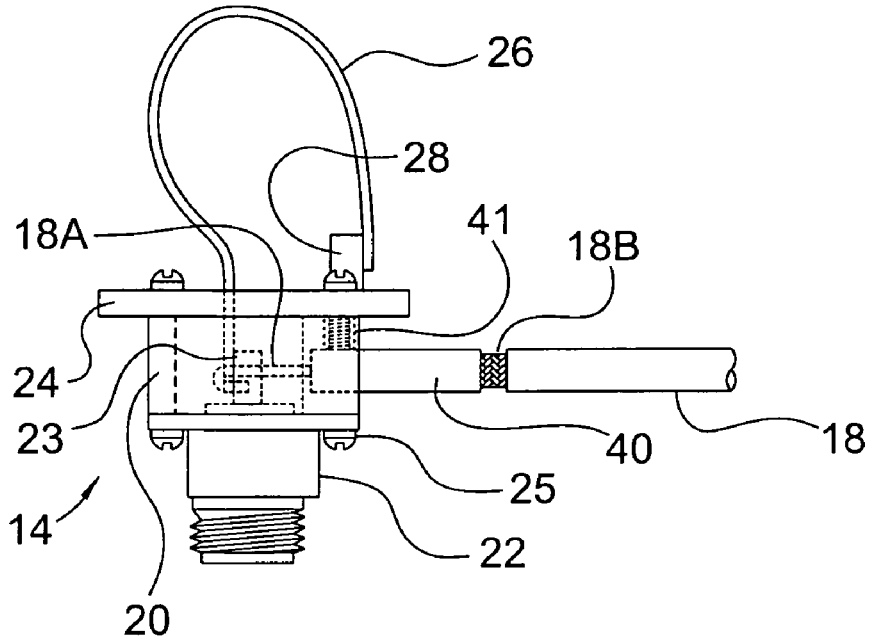
FIGS. 4A and 4B are side views of a sampler loop assembly including showing two alternative positions for grounding a loop of the loop assembly to a loop ring of the loop assembly.
Figure 4B:
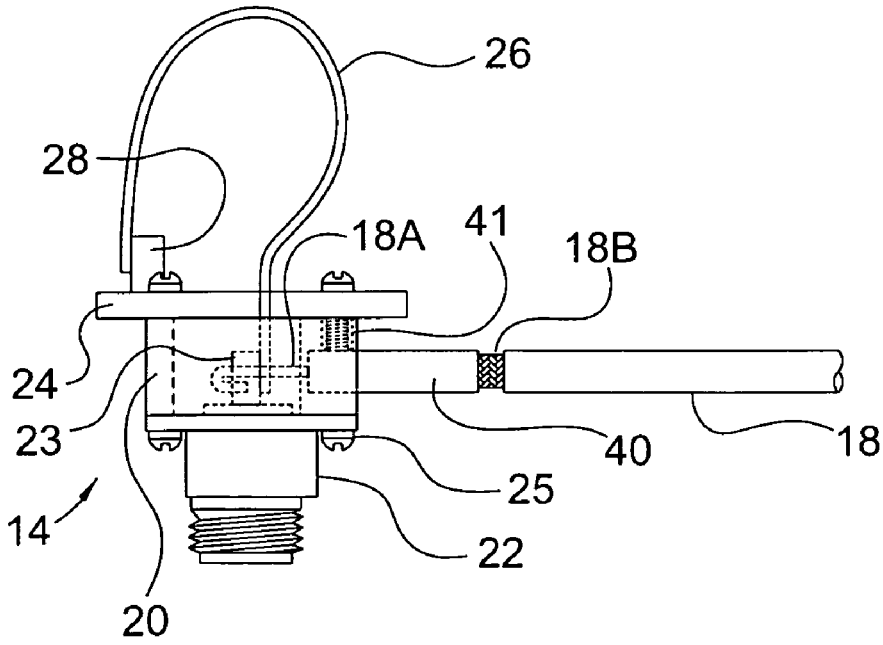

FIGS. 4A and 4B are front views of variable signal injection loop assemblies 16 which include grounding pins located at two alternate, opposite locations. FIG. 4A shows grounding pin 28 on the opposite side from where cable 18 is inserted into the connector block, while FIG. 4B shows grounding pin 28 on the same side as the insertion of cable 18. Varying the position of the grounding pin will effect the performance of the phase cancellation circuit, as discussed below.

Figure 5:
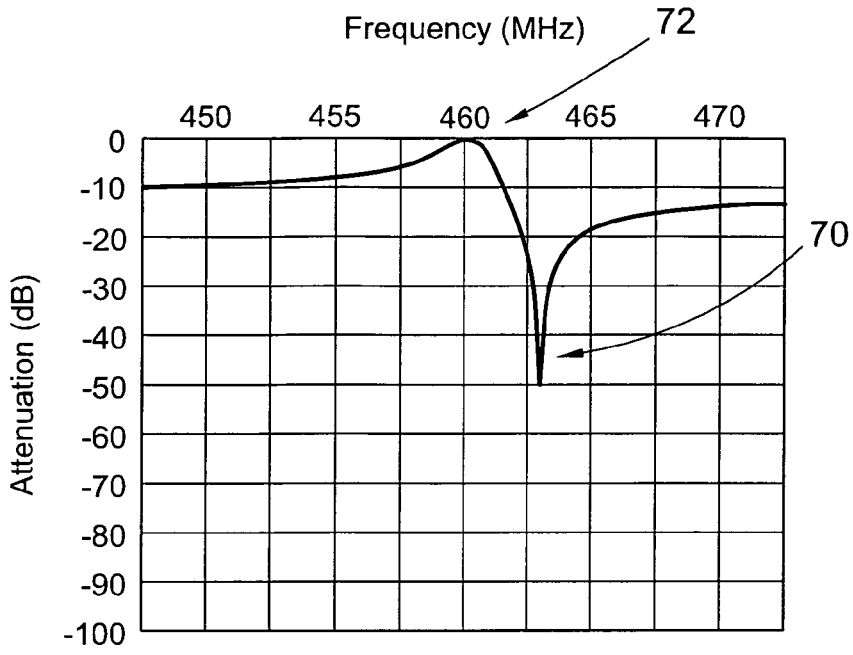
FIG. 5 is a diagram of the performance of a theoretical band pass cavity filter including the current invention phase cancellation circuit and grounded as shown in FIG. 4B; and, FIGS. 6-8 are diagrams of the performance of a theoretical cavity filter including the current invention phase cancellation circuit and grounded as shown in FIG. 4A, as a position of a voltage probe of the phase cancellation circuit is incrementally moved.
Figure 6:
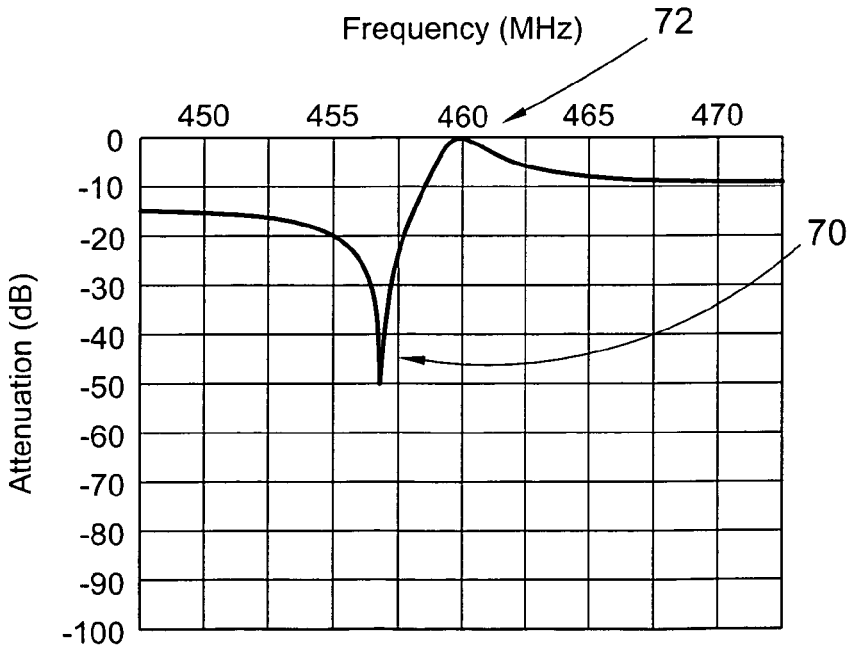

FIGS. 5-8 are diagrams of the theoretical performance of a band pass cavity filter including to phase cancellation circuit 10, illustrating notch 70 at a frequency above pass band 72. In the shown example, pass band 72 occurs a range of frequencies surrounding 460 MHz. The notch will flip to the opposite side of the pass band for each incremental half-wavelength that is added to the length of the cable. For example, if the cavity filter is arranged so that the notch is above the pass band, as shown in FIG. 5, increasing the cable by another half-wavelength will produce a notch below the pass band, such as shown in FIG. 6. By below the pass band we mean at a lower frequency than the pass band frequency, and similarly, by above we mean at a higher frequency than the pass band frequency. It should be appreciated that the diagrams of FIGS. 5-8 are included for explanation purposes only and should in no way limit the current invention.

By varying the position of the grounding pin from the arrangement in FIG. 4A to the arrangement in FIG. 4B, notch 70 will alternate between the low and high sides of the pass band, respectively. It should therefore be appreciated that switching the position of the grounding pin, such as from the arrangement in FIG. 4A to FIG. 4B, will change the position of the notch, without requiring a change in the length of cable 18. That is, alternating the position of grounding pin 28 from the arrangement of FIG. 4B to the arrangement of FIG. 4A will produce notches on opposite sides of the pass band. This behavior is generally depicted by FIGS. 5 and 6 which show notch 70 on the high side and low side of pass band 72, respectively.

Figure 7:
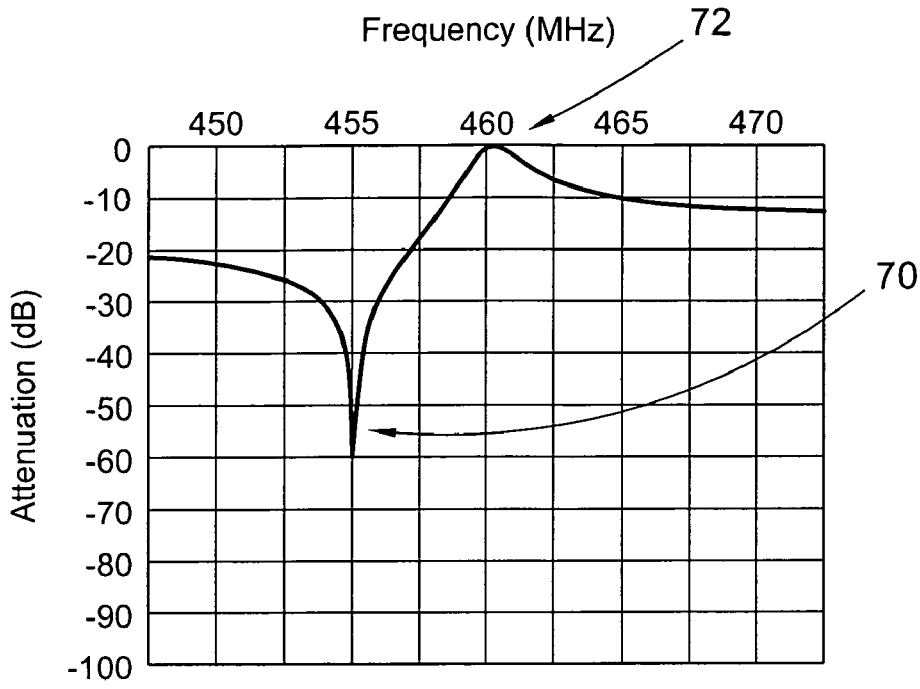
Figure 8:
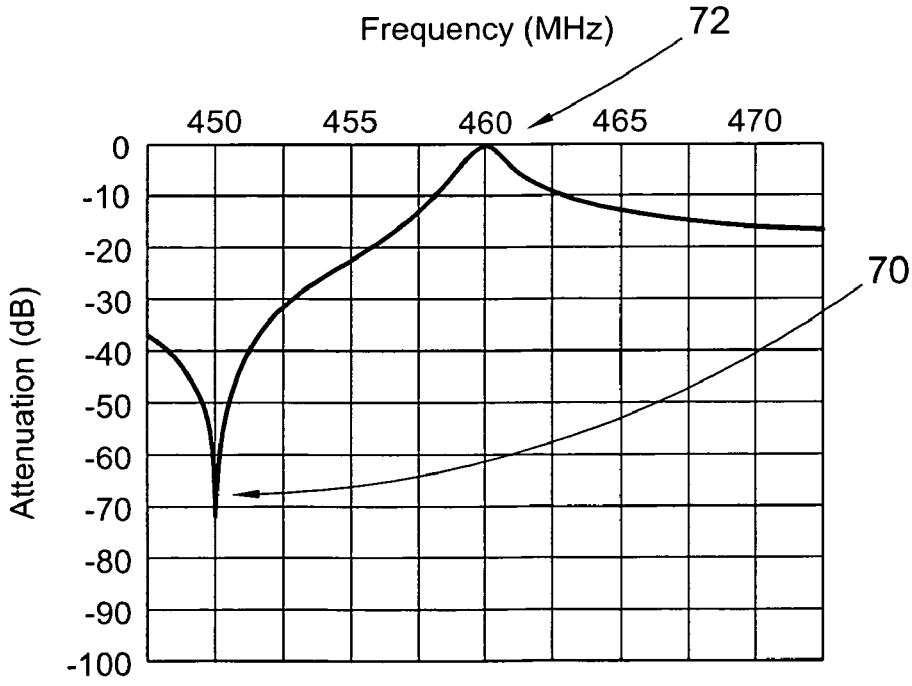

FIGS. 6-8 are diagrams showing a theoretical performance of a bandpass filter including phase cancellation circuit 10, that results from moving the position of voltage probe 42 incrementally out from connector block 30. That is, the relative position of the voltage probe to the coupling tube affects the resulting field coupling, which in turn affects the performance of the phase cancellation circuit. FIG. 6 shows the theoretical performance of the cavity filter with phase cancellation circuit 10 when the voltage probe is deeply inserted into connector block 30, and therefore the coupling tube. This produces notch 70 close to pass band 72, and the notch is inherently narrow in bandwidth exhibits limited attenuation.

As the cable and voltage probe are incrementally pulled out of the connector block, the performance of which is shown progressively in FIGS. 6-8, it can be seen that the notch 70 moves away from pass band 72, and the notch becomes wider in bandwidth, with increasing attenuation.

Therefore, it should be appreciated that by altering the length of the cable, shifting the grounding pins, and changing the position of the voltage probe with respect to the coupling tube, the phase cancellation can be achieved over a broad frequency range, above or below the cavity filter pass band. Alternatively stated, the notch created by the phase cancellation circuit is tunable.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A phase cancellation circuit for a cavity filter comprising:

a sampler loop assembly operatively arranged to receive an input signal to said cavity filter;

a variable signal insertion loop assembly connected to said sampler loop assembly by a cable, wherein said variable signal insertion loop assembly is operatively arranged to transmit an output signal from said cavity filter;

wherein said sampler loop assembly samples a cancellation signal at a desired isolation frequency from said input signal and transmits said cancellation signal to said variable signal insertion loop assembly via said cable; and, wherein said cable has a length, and said length is equal to a multiple of a half-wavelength at said desired isolation frequency, wherein said cancellation signal undergoes a 180° phase shift by traveling through said cable, wherein said variable signal insertion loop assembly combines said cancellation signal with said input signal, wherein said 180° phase shift cancels said input signal at said isolation frequency for creating said output signal, and wherein said output signal substantially resembles said input signal but with a notch at said desired isolation frequency;

wherein said sampler loop assembly comprises:

a bulkhead connector for receiving said input signal;

a connector block secured to said bulkhead connector, wherein said connector block is hollow and includes an aperture for enabling insertion of said cable into said connector block;

a loop ring secured to said connector block opposite from said bulkhead connector; and, a loop extending out of said connector block, wherein a first end of said loop is affixed to a center pin of said bulkhead connector and a second end of said loop is grounded to said loop ring.

2. The phase cancellation circuit recited in claim 1 wherein a first end of said cable is stripped to a center conductor wire of said cable, and said center conductor wire is affixed to said center pin of said bulkhead connector and to said loop.

3. The phase cancellation circuit recited in claim 2 wherein a rigid sleeve is affixed to said cable proximate to said first end of said cable, and wherein said rigid sleeve is positioned in said aperture and clamped to said connector block by a set screw.

4. A phase cancellation circuit for a cavity filter comprising:

a sampler loop assembly operatively arranged to receive an input signal to said cavity filter;

a variable signal insertion loop assembly connected to said sampler loop assembly by a cable, wherein said variable signal insertion loop assembly is operatively arranged to transmit an output signal from said cavity filter;

wherein said sampler loop assembly samples a cancellation signal at a desired isolation frequency from said input signal and transmits said cancellation signal to said variable signal insertion loop assembly via said cable; and, wherein said cable has a length, and said length is equal to a multiple of a half-wavelength at said desired isolation frequency, wherein said cancellation signal undergoes a 180° phase shift by traveling through said cable, wherein said variable signal insertion loop assembly combines said cancellation signal with said input signal, wherein said 180° phase shift cancels said input signal at said isolation frequency for creating said output signal, and wherein said output signal substantially resembles said input signal but with a notch at said desired isolation frequency;

wherein said variable signal insertion loop assembly comprises:

a bulkhead connector for transmitting said output signal;

a connector block secured to said bulkhead connector, wherein said connector block is hollow and includes an aperture for enabling insertion of said cable into said connector block;

a loop ring secured to said connector block opposite from said bulkhead connector;

a coupling tube housed within said connector block, wherein said coupling tube includes a hole for partial insertion of a central pin of said bulkhead connector into said coupling tube, wherein said couple tube rests on a non-conductive spacer that separates said bulkhead connector from contacting said coupling tube;

a dielectric ring concentrically arranged within said coupling tube; and, a loop extending out of said connector block, wherein a first end of said loop is affixed to said coupling tube and a second end of said loop is grounded to said loop ring.

5. The phase cancellation circuit recited in claim 4 wherein a second end of said cable is stripped down to a center conductor wire of said cable, wherein said center conductor wire is fitted with a voltage probe, and wherein said voltage probe is inserted through said aperture in said block connector and concentrically positioned within said dielectric tube for creating a field coupling between said coupling tube and said voltage probe.

6. The phase cancellation circuit recited in claim 5 wherein a rigid sleeve is affixed to said cable proximate to said second end of said cable, and wherein said rigid sleeve is positioned in said aperture and clamped in place by a shaft lock arranged about said aperture.

7. A method of creating a notch in a signal at a desired isolation frequency transmitted through a cavity filter comprising the steps of:

(a) receiving an input signal with a cavity filter;

(b) sampling a cancellation signal from said input signal at said desired isolation frequency;

(c) shifting said cancellation signal 180° by transmitting said cancellation signal through a cable having a length equal to a multiple of a half-wavelength at said desired isolation frequency;

(d) combining said cancellation signal with said input signal for cancelling said input signal at said desired isolation frequency, thereby creating an output signal that substantially resembles said input signal, but with a notch at said desired isolation frequency; and, (e) transmitting said output signal from said cavity filter; and, (f) tuning said phase cancellation circuit by altering a position of a voltage probe with respect to a coupling tube housed within a connector block of said variable signal insertion loop assembly, wherein said voltage probe is affixed to one end of said cable.

8. The method of claim 7 wherein step (f) occurs before step (a).

* * * * *